United States Patent [19]

Schwartz et al.

[11] Patent Number: 4,674,799

[45] Date of Patent: Jun. 23, 1987

[54] LAWN FURNITURE AND METHOD OF MAKING SAME

[76] Inventors: Larry A. Schwartz, 500 Central Park Ave., Scarsdale, N.Y. 10503; Bertram Lesser, 100 Polifly Rd., Hackensack, N.J. 07601

[21] Appl. No.: 695,263

[22] Filed: Jan. 28, 1985

[51] Int. Cl.[4] ..... A47C 5/00

[52] U.S. Cl. ..... 297/445; 297/450; 297/DIG. 2

[58] Field of Search ..... 297/445, 451, 450, DIG. 2

[56] References Cited

U.S. PATENT DOCUMENTS

| | | | |
|---|---|---|---|
| 3,041,110 | 6/1962 | King et al. | 297/451 |
| 3,601,446 | 8/1971 | Persson | 297/445 |
| 3,698,150 | 10/1972 | Anderson | 297/445 X |
| 3,844,612 | 10/1974 | Borggren et al. | 297/445 |
| 3,873,154 | 3/1975 | Baker | 297/445 |
| 4,361,357 | 11/1982 | Pollock | 297/445 |
| 4,456,301 | 6/1984 | Apissomian | 297/445 |
| 4,542,938 | 9/1985 | Tisbo et al. | 297/445 |

FOREIGN PATENT DOCUMENTS

| | | | |
|---|---|---|---|
| 642549 | 7/1962 | Italy | 297/445 |

*Primary Examiner*—Francis K. Zugel

*Attorney, Agent, or Firm*—Lerner, David, Littenberg, Krumholz & Mentlik

[57] ABSTRACT

A light-weight, weather-proof piece of lawn furniture is constructed of hollow rigid outer polyvinylchloride extrusions which are heated and pulled over metal rods forming members having the same shape as the metal rods. The metal reinforced polyvinylchloride extrusions are connected to form the frame of, for example, a chair. Straps are connected across portions of the frame to form a back and a seat of the chair.

8 Claims, 3 Drawing Figures

LAWN FURNITURE AND METHOD OF MAKING SAME

BACKGROUND OF THE INVENTION

The present invention is related generally to furniture and more specifically to lawn furniture and methods of making same.

Lawn furniture is a common article which may take the form of a chair, rocking chair, lounge chair, table, etc. Lawn furniture is available in a wide variety of styles and colors and is manufactured from a large variety of materials. In producing lawn furniture, it is desirable to select materials which are impervious to the weather such that the furniture will not rot, rust, corrode, etc., are readily available, and which are suitable for mass production techniques. It is further desirable to construct the furniture of light-weight materials such that they may be easily moved and stored. Despite the desire to make the furniture light-weight it is still necessary to make the furniture as rugged and sturdy as possible. The desire to make lawn furniture light-weight and sturdy requires trade-offs between competing design engineering criteria.

SUMMARY OF THE INVENTION

The present invention is disclosed in conjunction with the description of a lawn chair. It should be recognized, however, that the principles of the present invention are equally applicable to other types of lawn furniture.

The lawn chair disclosed herein is constructed of at least one metal rod bent to form the frame of a chair. A hollow extruded member is heated to a temperature above its forming temperature but below its melting temperature making it soft and pliable. The heated member is pulled over the metal rod thereby forming a member which is strong, light-weight, and impervious to the weather. Straps or the like are connected to the member to form a back and a seat of the chair.

Other embodiments of the present invention use more than one metal rod to form the chair's frame. For example, in one embodiment first and second metal rods are bent into curved rods. A third metal rod is bent into a U-shaped rod having an upper portion and a lower portion at the open end of the U. The lower portion of the U-shaped rod forms an obtuse angle with the upper portion.

Hollow polyvinylchloride extrusions are heated to a temperature above their forming temperature but below their melting temperature and pulled over the metal rods to form members having the same shape as the shape of the metal rods. After the polyvinylchloride has cooled, each side of the U-shaped member is connected across one of the curved members at two points such that opposite ends of each curved member form a front and back leg of the chair and the middle portion of the curved member forms an arm of the chair. Plastic straps are connected between the sides of the U-shaped member to form a back of the chair at the upper portion of the U-shaped member and a seat at the lower portion of the U-shaped member.

One aspect of the present invention is the manner of connecting the curved hollow members to one another in an embodiment where the hollow extrusions contain more than one hollow longitudinally-extending chamber. In that case, a hole is drilled through the members at the point where the members are to be connected. A second hole, larger than the head of the bolt which will be used to connect the two members, is drilled through the wall of the empty chamber. Thus, when the bolt is inserted the bolt's head will abut the chamber carrying the metal rod rather than an empty chamber.

Lawn furniture constructed according to that method is light-weight because of the hollow polyvinylchloride extrusions. However, the steel frame within the rigid hollow polyvinylchloride extrusions provides additional strength and rigidity. The joints between the members are stronger because the bolt head solidly abuts the chamber carrying the metal rod. A further advantage of having the steel frame within the polyvinylchloride extrusions is that the steel is protected from the environment and thus less susceptible to rust.

The present invention is for light-weight, weatherproof lawn furniture constructed of readily available materials by procedures which are easily adaptable to mass production techniques. Other advantages and benefits of the present invention will become apparent from the description of the preferred embodiment.

DESCRIPTION OF THE PREFERRED EMBODIMENT

Figure 1:
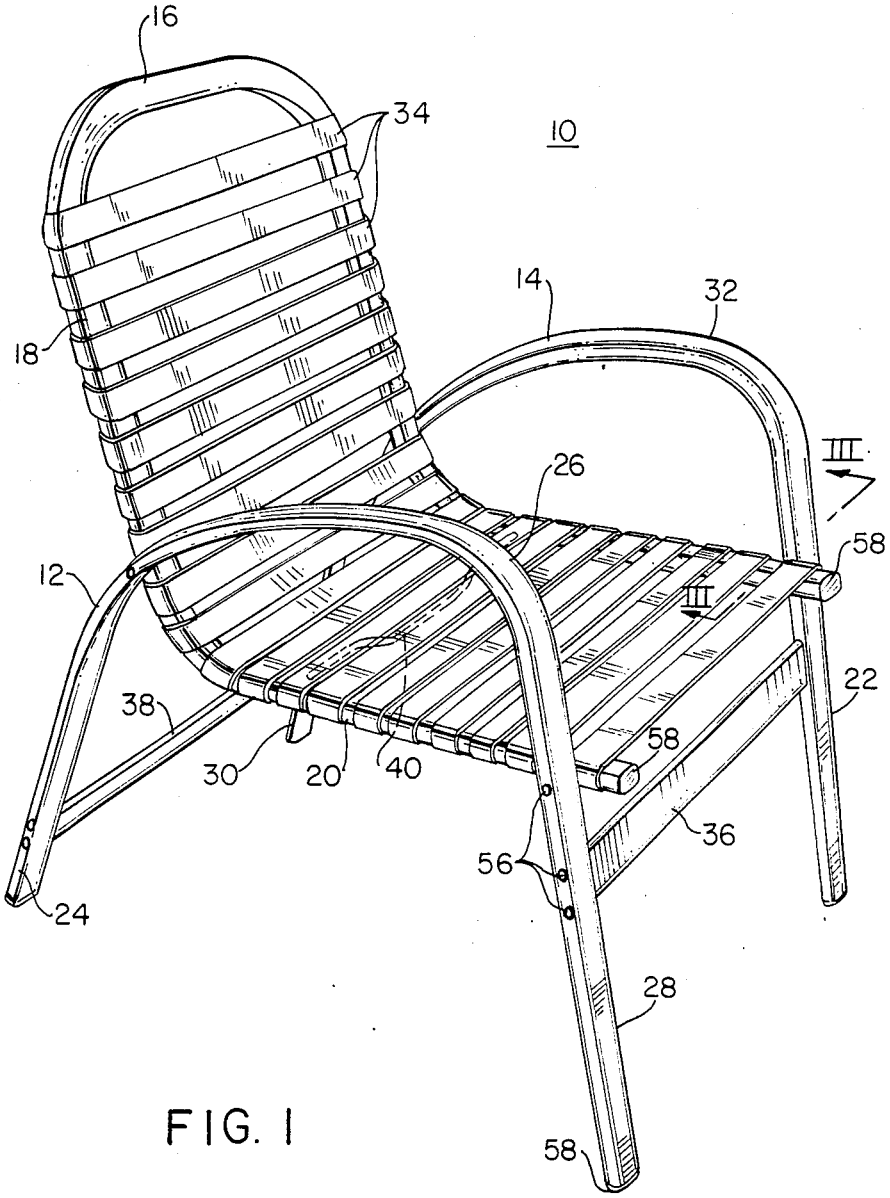
FIG. 1 is perspective view of a lawn chair constructed according to the present invention.

In FIG. 1 a perspective view of a piece of lawn furniture, specifically a lawn chair 10 constructed according to the teachings of the present invention is shown. The chair 10 shown in the figures is only one embodiment of various types of chairs used to demonstrate the principles of the present invention and is not intended to limit the present invention to a chair or a chair of that particular design.

The chair 10 is constructed of a first hollow rigid curved member 12, a second hollow rigid curved member 14, and a third hollow rigid U-shaped member 16. The U-shaped member 16 has an upper portion 18 and a lower portion 20. The lower portion 20 is at the open end of the U-shaped member 16 and forms an obtuse angle with the upper portion 18 of the U-shaped member 16. The hollow members 12, 14, and 16 can be constructed of any plastic-like material which is pliable at elevated temperatures but rigid at lower temperatures. In one embodiment the hollow members 12, 14 and 16 are each composed of hollow polyvinylchloride extrusions reinforced with steel rods (not shown in FIG. 1). Aluminum, or any other suitable metal, could also be used for reinforcing the polyvinylchloride extrusions.

One side of the U-shaped member 16 is connected at two points across the curved member 12 such that the opposite ends of the curved member 12 form a front leg 22 and a back leg 24 of the chair 10. The portion of the curved member 12 between the two points of connection with the U-shaped member 16 defines an arm 26 of the chair 10.

In a similar fashion, the other side of the U-shaped member 16 is connected across the curved member 14 at two points such that opposite ends of the curved member 14 form a front leg 28 and a back leg 30 of the chair 10 and the portion of the curved member 14 between the two points of connection with the U-shaped member 16 defines an arm 32 of the chair 10.

A plurality of straps 34 are connected between the sides of the U-shaped member 16. Those straps 34 form a back of the chair when connected across the upper portion 18 of the U-shaped member 16 and form a seat of the chair when connected across the lower portion 20 of the U-shaped member 16. The straps 34 may be plastic, cloth, or any suitable material. In addition, straps need not be used at all. For example, a single piece of cloth or other material may be appropriately connected between the sides of the U-shaped member 16.

Completing the description of the chair 10 shown in FIG. 1, a support member 36 is connected between the front legs 22 and 28. In a similar fashion, a support member 38 is connected between the back legs 24 and 30. Those supports provide additional strength and rigidity to the chair. A last support member 40 is connected across the lower portion 18 of the U-shaped member 16. The support 40 is positioned underneath the seat of the chair 10 to prevent the open end of the U-shaped member 16 from twisting or closing when the chair is being used. In one embodiment the support members 36 and 38 are hollow polyvinylchloride members and the support member 40 is a steel rod.

The first and second hollow polyvinylchloride members 12 and 14, respectively, and the hollow U-shaped polyvinylchloride member 16 have steel support rods (not shown in FIG. 1) running therethrough. Those steel support rods provide a metal frame giving support and rigidity to the chair.

The fabrication of the first and second curved members 12 and 14, respectively, and the U-shaped member 16 is accomplished in one embodiment by first bending steel support rods to form a first curved rod having a shape similar to the shape of the curved member 12, a second curved rod having a shape similar to the shape of the curved member 14, and a third rod having a shape similar to the shape of the U-shaped member 16. After the steel rods have been appropriately bent, hollow polyvinylchloride extrusions prepared from any commercially available resins are cut to the appropriate length. Alternatively, the polyvinylchloride may be extruded in the proper lengths. The hollow extrusions are then heated to a temperature of approximately 300° C. which is about the forming temperature of most commercially available polyvinylchlorides but below their melting temperatures. At that temperature, the polyvinylchloride becomes flexible but does not lose its dimensional stability.

The polyvinylchloride extrusions may be heated to the forming temperature in a variety of ways. For example, the extrusions may be immersed in an oil bath or placed within heating coils to elevate the temperature of the entire member. Alternatively, the extrusions may be placed on a conveyor belt over gas jets which selectively heat only those areas which must be flexible in order to facilitate pulling the polyvinylchloride extrusions over the steel rods.

Once the polyvinylchloride extrusions have been pulled over their respective steel rods, the entire member is placed in a jig to prevent the warm polyvinylchloride from twisting and the member and jig are placed in a cold water bath. The cold water bath lowers the temperature of the polyvinylchloride below the forming temperature such that it again becomes rigid.

The fabrication of the first and second curved members 12 and 14, respectively, and the U-shaped member 16 may alternately be accomplished by standard cold rolling techniques. Steel rods are positioned inside the polyvinylchloride extrusions which are then positioned on bending forms. Sufficient pressure is applied to cold bend the members. Because the polyvinylchloride extrusions must be given sufficient time to become properly oriented, the bending process should be performed at a sufficiently slow rate to prevent tearing or rupturing of the polyvinylchloride extrusions.

Figure 3:
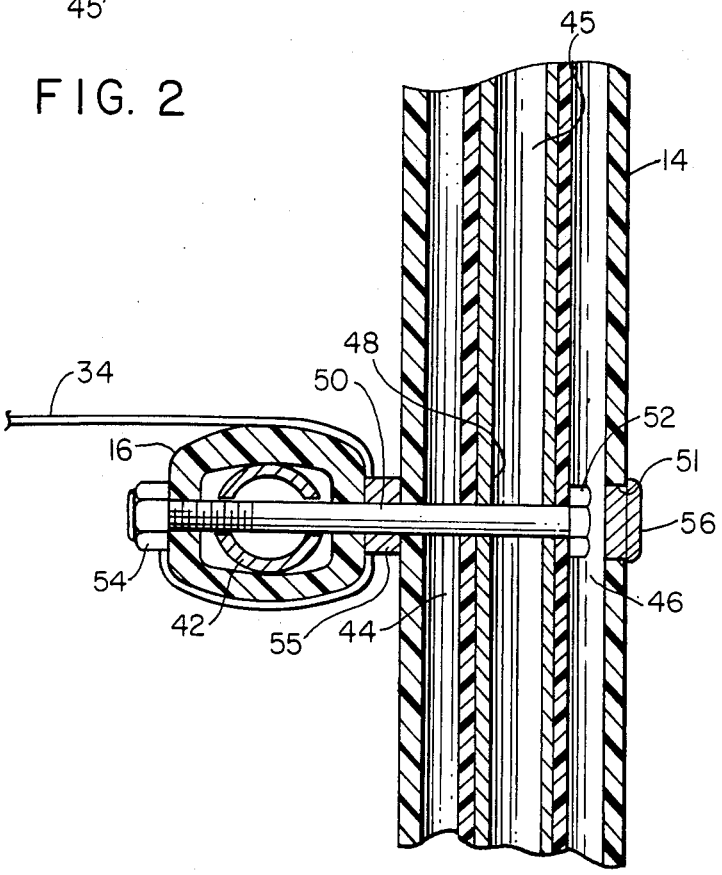
FIG. 3 is a cross-sectional view of a joint of the lawn chair of FIG. 1 taken along the lines III—III.

The exact configuration of the hollow polyvinylchloride extrusions used for the various members may vary. For example, a cross-sectional view of the U-shaped member 16 is shown in FIG. 3 wherein like components have the same reference numerals. As can be seen in FIG. 3, the U-shaped member 16 is substantially rectangular with a hollow center. A steel rod 42 within the U-shaped member 16 is itself hollow, and may be located anywhere within the hollow center of the member 16.

Figure 2:
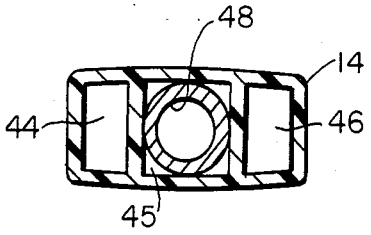
FIG. 2 is a cross-sectional view of the curved members.

A cross-sectional view of the second curved member 14 is shown in FIG. 2. The following discussion of FIG. 2 is equally applicable to the first curved member 12. A different form for the members 12 and 14 has been chosen from that of U-shaped member 16 because of the different functions which the curved members 12 and 14 must perform. Opposite ends of the curved members 12 and 14 form the front legs 22 and 28 and back legs 24 and 30 of the chair 10. The middle portions of the curved members 12 and 14 form the arms 26 and 32 of the chair 10. It is desirable to have a wide relatively flat member for the curved members 12 and 14 such that the legs will be large enough to provide a solid support for the chair and the arms will be wide enough to provide comfort to the user. As can be seen in FIG. 2, the second curved member 14 has a first longitudinally-extending hollow chamber 44, a second longitudinally-extending hollow chamber 45, and a third longitudinally-extending hollow chamber 46. The second hollow chamber 45 carries a steel rod 48 although it could also be carried by the first or third longitudinally-extending hollow chambers 44 and 46, respectively. In this manner, the second hollow member 14 is substantially lightweight because of the hollow chambers 44, 45, and 46 yet extremely strong because of the steel rod 48 within the chamber 45.

An important feature of the present invention is the interconnection of the hollow members to form the frame. In the embodiment being described, the U-shaped member 16 is connected to the first and second curved members 12 and 14, respectively. Shown in FIG. 3 is a cross-sectional view of a typical joint between the second curved member 14 and the U-shaped member 16 taken along the line III—III in FIG. 1. The cross-sectional view illustrates the inside of the second curved member 14 showing the chambers 44, 45, and 46 and the steel rod 48 as shown in FIG. 2.

In connecting the U-shaped member 16 to the second curved member 14 a hole is drilled through the members 14 and 16 for receiving a threaded bolt 50. A second hole 51 larger than the head 52 of the bolt 50 is drilled in the outer wall of the chamber 46. That second hole 51 allows the head of the bolt 52 to abut the wall of the chamber 45 carrying the steel rod 48. A nut 54 is attached at the other end of the bolt 50 to complete the joint. Because the head 52 of the bolt 50 abuts the wall of the chamber 45 carrying the steel rod 48, when the nut 54 is tightened a very strong joint is created. That stronger joint prevents movement between the members 14 and 16 and increased the overall strength and rigidity of the lawn chair 10.

A spacer 55 may be placed between the members 14 and 16. Finally, capping plug 56 is inserted in the hole 51 to secure the joint against the environment. The spacer 55 and capping plug 56 may be made of polyvinylchloride or any suitable material. The other connections between the U-shaped member 16 and the first and second curved members 12 and 14, respectively, are identical to the above-described connection.

The support members 36 and 38 shown in FIG. 1 are attached between the first curved member 12 and the second curved member 14 by screws, not shown. The support members 36 and 38 are hollow and contain no steel rods. When connecting the support members 36 and 38, a first hole is drilled through the member 12 or 14. A second hole is then drilled, similar to hole 51, which is larger than the head of the screw such that the head of the screw can abut the wall of chamber 45 carrying the steel rod 48. In this manner, the strength of the joint between the support members 36 and 38 and the first and second curved members 12 and 14 is increased. Finally, the holes are plugged with capping plugs 56 to secure the joint from the environment.

The construction of the chair 10 shown in FIG. 1 is completed by inserting end plugs 58 in the open ends of the first curved member 12, second curved member 14, and the U-shaped member 16. The end plugs 58 may be of a polyvinylchloride material similar in color and composition to the material forming the curved members 12 and 14 and the U-shaped member 16.

The embodiment shown and described above is intended to be illustrative and in no way intended as a limitation. It is recognized that numerous modifications of the disclosed embodiment may be made without departing from the scope and content of the present invention as defined by the following claims.

What we claim is:

1. A light-weight, weather-proof lawn chair having improved strength, comprising:

first and second arcuate hollow rigid outer plastic members each having two spaced-apart web members formed therein, said web members dividing the hollow interior of said first and second arcuate hollow rigid outer plastic members into three enclosed longitudinally-extending chambers separated from each other by said web members, said first and second arcuate hollow rigid outer plastic members forming front legs, back legs and arm portions of said chair;

a third arcuate hollow rigid outer plastic member having an upper portion and a lower portion, said lower portion arranged at an angle to said upper portion, opposite sides of said third arcuate hollow rigid outer plastic member being connected across one of said first and second arcuate hollow rigid outer plastic members at two points, whereby opposite ends of each of said first and second arcuate hollow rigid outer plastic members form said front legs and said back legs of said chair and a portion of said first and second aracuate hollow rigid outer plastic members between said two points defining said arm portions of said chair;

metal inner longitudinally-extending members having the same shape as and being located within one of said longitudinally-extending chambers of said first and second arcuate hollow rigid outer plastic members and within the hollow interior of said third arcuate hollow rigid outer plastic member to provide strength thereto; and a membrane connected between the sides of said third arcuate hollow rigid outer plastic member forming a back support of said chair at said upper portion and a seat support of said chair at said lower portion, said chair including a support member connected between the sides of said third hollow rigid outer plastic member, or between said legs, for maintaining the distance therebetween, wherein one of said metal inner longitudinally-extending members is located within each middle one of said longitudinally-extending chambers, and wherein said web members are integrally formed with said first and second arcuate hollow rigid outer plastic members.

2. The chair of claim 1 wherein said first, second and third hollow outer plastic members comprise extruded polyvinyl chloride.

3. The chair of claim 1 wherein said metal inner longitudinally-extending members each comprise a hollow cylindrical steel tube.

4. The chair of claim 1 including end caps for covering the open ends of said hollow outer rigid plastic members.

5. The chair of claim 1 wherein said third arcuate hollow rigid outer plastic member comprises a U-shaped member having open ends.

6. The chair of claim 1 wherein said membrane comprises a plurality of straps.

7. The chair of claim 1 further including connecting means for connecting said third arcuate hollow rigid outer plastic member to each of said first and second arcuate hollow rigid outer plastic members.

8. The chair of claim 7 wherein said connecting means comprises a bolt having a head portion, said head portion abutting one of said web members adjacent said longitudinally-extending chamber containing one of said metal inner longitudinally-extending members.

* * * * *